United States Patent [19]

Ando et al.

[11] Patent Number: 4,705,002

[45] Date of Patent: Nov. 10, 1987

[54] ELECTRONIC AIR-FUEL MIXTURE CONTROL SYSTEM FOR INTERNAL COMBUSTION ENGINE

[75] Inventors: Tsuneo Ando; Kazusato Kasuya; Yukitoshi Asada; Hironobu Sugimoto, all of Oobu, Japan

[73] Assignee: Aisan Kogyo Kabushiki Kaisha, Oobu, Japan

[21] Appl. No.: 846,552

[22] Filed: Mar. 31, 1986

[30] Foreign Application Priority Data

Mar. 29, 1985 [JP] Japan ..... 60-67797

[51] Int. Cl.[4] ..... F02D 41/14

[52] U.S. Cl. ..... 123/440; 123/438; 123/486

[58] Field of Search ..... 123/438, 440, 480, 486, 123/489; 364/431.05

[56] References Cited

U.S. PATENT DOCUMENTS 4,348,727 9/1982 Kobayashi et al. ..... 123/480

4,466,410 8/1984 Sakakibara et al. ..... 123/480

FOREIGN PATENT DOCUMENTS 58-150057 9/1983 Japan .

*Primary Examiner*—Andrew M. Dolinar

*Attorney, Agent, or Firm*—Oblon, Fisher, Spivak, McClelland, & Maier

[57] ABSTRACT

An electronic air-fuel mixture control system is adapted to an internal combustion engine to determine an optimum air-fuel ratio in dependence upon renewal of plural learning values related to a plurality of load regions of the engine. The control system is arranged to select one of the learning values in accordance with the engine load and to prohibit learning of the selected learning value when a difference between the selected learning value and the adjacent learning value is more than an allowable value determined in consideration with allowable fluctuation of the air-fuel ratio caused by change of the amount of air flowing into the engine.

5 Claims, 14 Drawing Figures

ELECTRONIC AIR-FUEL MIXTURE CONTROL SYSTEM FOR INTERNAL COMBUSTION ENGINE

BACKGROUND OF THE INVENTION

1. Field of the Invention the present invention relates to an electronic air-fuel mixture control system for internal combustion engines, and more particularly to an electronic air-fuel mixture control system for determining an optimum air-fuel ratio in dependence upon learning values renewed in response to change of the load acting on the engine.

2. Discussion of the Background

Such an electronic air-fuel mixture control system as described above has been proposed in Japanese Patent Early Publication No. 58-150057, wherein a plurality of learning values related to a plurality of load regions are selectively renewed in response to change of the load acting on the engine so as to determine an optimum air-fuel ratio in dependence upon the renewed learning value. In such selective learning of the learning values, it is, however, observed that when the intake manifold pressure is transiently fluctuated by sudden change of the driving condition, the atmospheric pressure and the like, each of the learning values is inevitably renewed in response to such fluctuation of the intake manifold pressure. This results in transient disorder of the air-fuel ratio of the mixture.

SUMMARY OF THE INVENTION

It is, therefore, a primary object of the present invention to provide an improved electronic air-fuel mixture control system capable of determining an optimum air-fuel ratio in a reliable manner even when the air or fuel supply amount is transiently fluctuated by sudden change of the driving condition, the atmospheric pressure, the air temperature and the like.

According to the present invention briefly summarized, there is provided an electronic air-fuel mixture control system for an internal combustion engine, having an induction passage for conducting air-fuel mixture into the engine, fuel control means for controlling the amount of fuel metered into the air induction passage, and throttle means for controlling the amount of air flowing into the engine through the induction passage. The control system comprises first detecting means for producing a first signal indicative of the load acting on the engine, second detecting means for producing a second signal indicative of the operating conditions of the engine, means responsive to the first signal for selecting one of plural learning values in accordance with the engine load, the plural learning values being related to a plurality of load regions of the engine, learning means for learning the selected learning value, the learning means being arranged to prohibit learning of the selected learning value when a difference between the selected learning value and an adjacent learning value or another adjacent learning value is more than a predetermined allowable value, and means responsive to the second signal for determining an amount of fuel for an optimum air-fuel ratio in accordance with the operating conditions of the engine and the selected learning value, and means for producing an output signal indicative of the determined amount of fuel to apply it to the fuel control means.

In the actual practice of the present invention, the predetermined allowable value is determined in consideration with allowable fluctuation of the air-fuel ratio of the mixute caused by change of the amount of air flowing into the engine through the induction passage.

BRIEF DESCRIPTION OF THE DRAWINGS

Additional objects and advantages of the present invention will become more readily apparent from the following detailed description of preferred embodiments thereof when taken together with the accompanying drawings, in which.

DETAILED DESCRIPTION OF THE PREFERRED EMBODIMENTS

Figure 1:
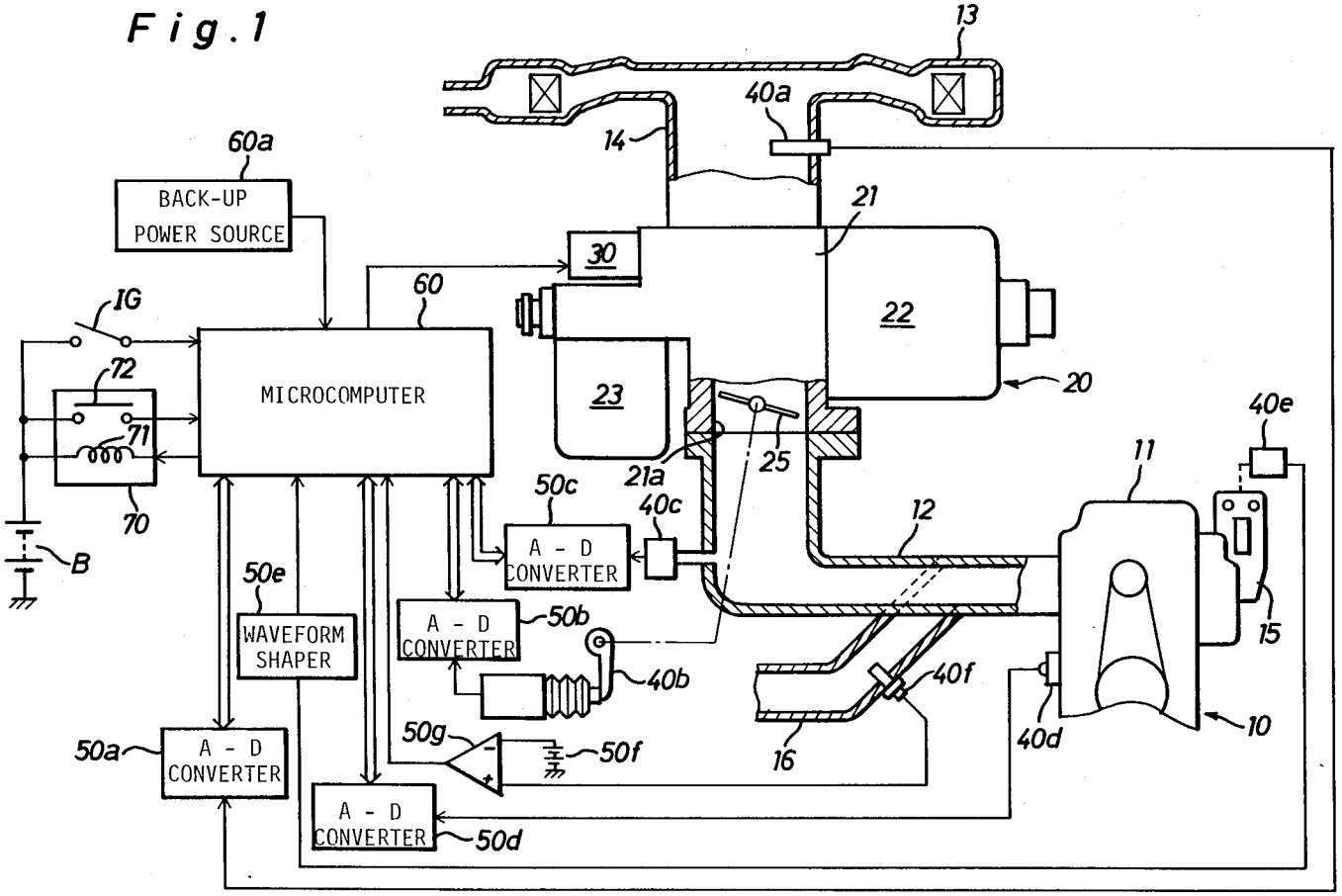
FIG. 1 is a schematic block diagram of an electronic air-fuel mixture control system for an internal combustion engine in accordance with the present invention.
Figure 2:
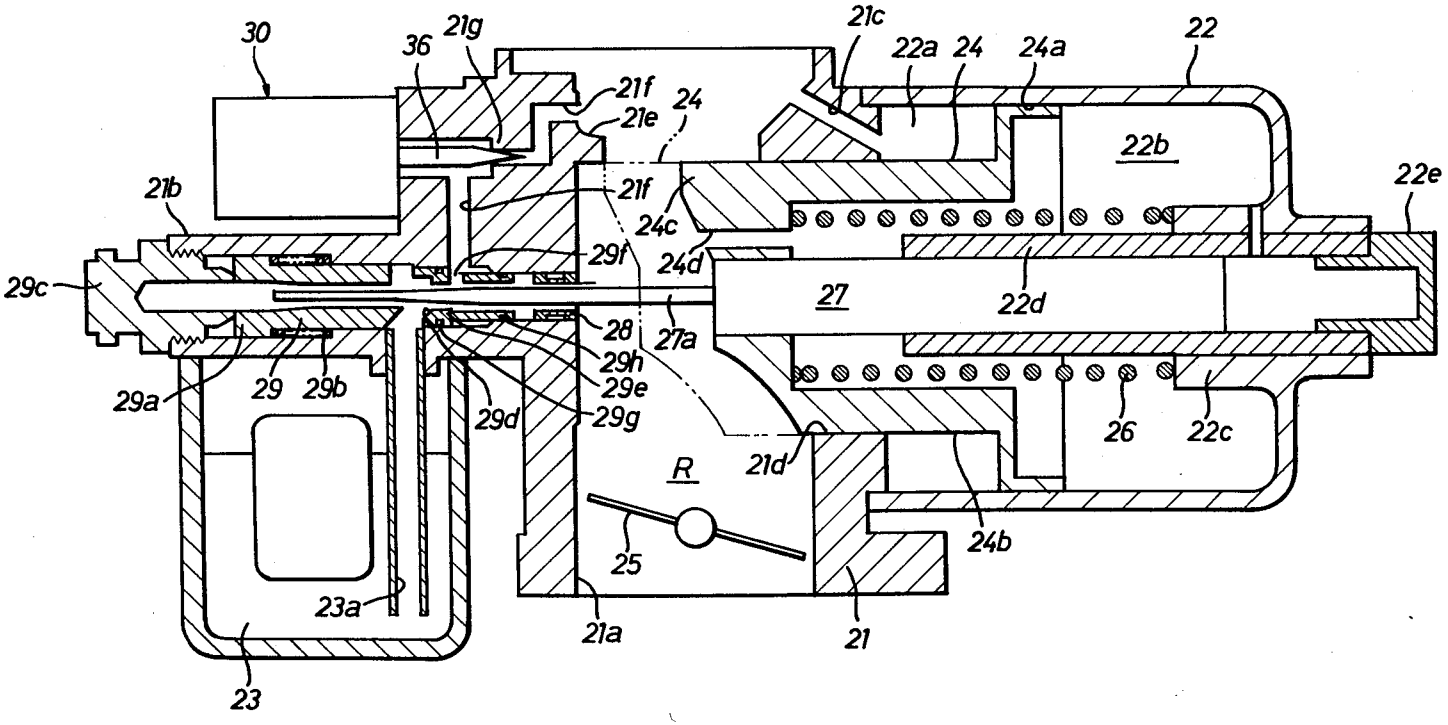
FIG. 2 is a sectional view of a carburetor adapted to the engine shown in FIG. 1.

Referring now to the drawings and particularly to FIG. 1, there is illustrated an electronic air-fuel mixture control system adapted to a carburetor 20 for an internal combustion engine 10. The carburetor 20 comprises a carburetor body 21 which is interposed between an intake manifold 12 connected with a cylinder block 11 of engine 10 and an air duct 14 provided thereon with an air cleaner 13. As shown in FIG. 2, the carburetor body 21 is formed therein with an induction or intake conduit 21*a* which contains, upstream of a main throttle valve 25 operated by the driver, an auxiliary throttle element 24. The auxiliary throttle element 24 is in the form of a spring loaded throttle piston arranged to form a mixing chamber R defined by the main throttle valve 25 and the throttle piston 24. The throttle piston 24 has a small diameter portion 24*b* axially slidably supported at 21*d* on a peripheral wall of the carburetor body 21 and has a head portion 24*c* which cooperates with an internally protruded portion 21*e* of carburetor body 21 to provide a variable venturi for controlling the flow of air into the intake conduit 21*a*.

A hollow cylindrical casing 22 is hermetically fixed to the peripheral wall of carburetor body 21 to contain therein a cylindrical large diameter portion 24*a* of piston 24. The interior of casing 22 is subdivided by the large diameter portion 24*a* of piston 24 into an atmospheric chamber 22*a* and a vacuum chamber 22*b* which are respectively in open communication with the atmosphere through an air passage 21*c* in the peripheral wall of body 21 upstream of the throttle piston 24 and in open communication with the mixing chamber R through a suction passage 24*d* in piston 24. A guide rod 27 is fixed to the head portion 24*c* of throttle piston 24 and axially slidably supported by a guide sleeve 22*d* which is fixedly mounted at its outer end on the cylindrical casing 22. The guide sleeve 22*d* is arranged coaxially with the throttle piston 24 and is closed by a closure plug 22*e* secured thereto. A compression coil spring 26 in surrounding relationship with the guide sleeve 22*d* is engaged at one end thereof with an annular inner wall 22*c* of casing 22 to bias the throttle piston 24 toward the internally protruded portion 21*e* of carburetor body 21.

The carburetor body 21 is formed at one side thereof with a cylindrical portion 21*b* which is arranged coaxially with the throttle piston 24 to contain therein a needle valve element 27*a* extending from the inner end of guide rod 27. A cylindrical nozzle 28 is fixedly coupled within a stepped bore of cylindrical portion 21*b* and arranged in surrounding relationship with the needle valve element 27*a*. A stepped sleeve 29 is disposed within the stepped bore of the cylindrical portion 21*b* of carburetor body 21 through axially spaced sealing members 29*g* and 29*h*. The sleeve 29 is loaded by a compression coil spring 29*b* outwardly and engaged at its outer end 29*a* with the inner end of a closure plug 29*c* threaded into the cylindrical portion 21*b*. The sleeve 29 is formed at its intermediate portion with a radial hole 29*d* which is connected to a float chamber 23 through a vertical fuel pipe 23*a*. The inner end portion of sleeve 29 is formed therein with an annular metering jet 29*e* which cooperates with the needle valve element 27*a* to control the amount of fuel flowing therethrough. The inner end portion of sleeve 29 is further formed with a radial air hole 29*f* which connects the metering jet 29*e* to the upstream of internally protruded portion 21*e* through an air bleed passage 21*f*. Thus, fuel in the float chamber 23 is fed into the interior of sleeve 29 through the vertical fuel pipe 23*a* and mixed with the air from air bleed passage 21*f*. The air-fuel mixture is fed into the mixing chamber R through the nozzle 28 after it is metered by an annular gap between the needle valve element 27*a* and the metering jet 29*e*.

Figure 3:
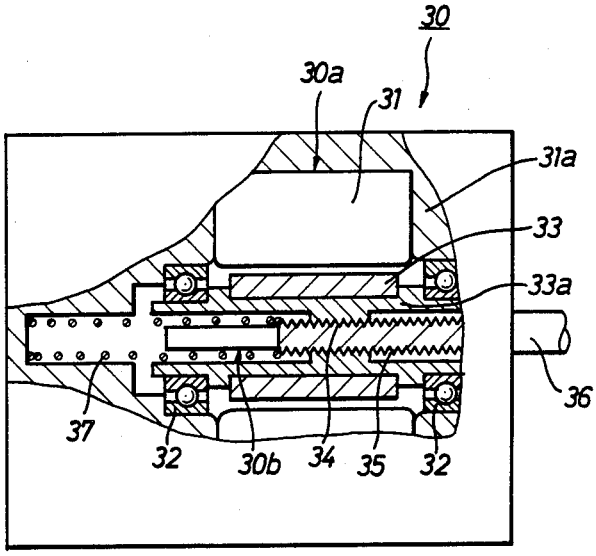
FIG. 3 is a partially sectioned view of an electric drive mechanism adapted to the carburetor shown in FIG. 2.

The carburetor 20 is provided with an electric drive mechanism 30 which is attached to the peripheral wall of carburetor body 21. As shown in FIG. 3, the drive mechanism 30 includes a stepper motor 30*a* and an axially displaceable plunger 30*b*. The stepper motor 30*a* comprises a stator 31*a* secured to an end wall of carburetor body 21 at a place adjacent the air bleed passage 21*f*, and an annular field winding 31 mounted within the stator 31*a* in surrounding relationship with a cylindrical rotor 33 which is fixed to a hollow shaft 33*a*. The hollow shaft 33*a* is rotatably supported by a pair of axially spaced ball bearings 32, 32 carried on the stator 31*a*. The plunger 30*b* has a male screw portion 35 threadedly engaged with a female screw portion 34 formed in the inner periphery of hollow shaft 33*a*, and a needle valve element 36 extending into the air bleed passage 21*f* from the male screw portion 35. The plunger 30*b* is guided by an internal portion of the stator 31*a* in such a manner as to be axially displaceable but not rotatable about its axis. The plunger 30*b* is loaded by a compression coil spring 37 toward the air bleed passage 21*f*. The needle valve element 36 is arranged to cooperate with an annular valve seat 21*g* in the air bleed passage 21*f* for controlling the amount of air flowing from the upstream of passage 21*f* into the metering jet 29*e*. In the above arrangement, axial displacement of the needle valve element 36 is effected by rotation of the rotor 33 caused by activation of the stepper motor 30*a*.

As shown in FIG. 1, the electronic air-fuel mixture control system for the carburetor 20 comprises analog-to-digital or A-D converters 50*a*, 50*b*, 50*c* and 50*d* each connected to an air temperature sensor 40*a*, a throttle position sensor 40*b*, a negative pressure sensor 40*c* and a cooling water temperature sensor 40*d*; a waveform shaper 50*e* connected to a rotational angle sensor 40*e*; and a comparator 50*g* connected to an exhaust gas oxygen sensor 40*f* and a standard signal generator 50*f*. The air temperature sensor 40*a* is disposed within the air duct 14 to detect a temperature of air flow in the duct 14 for producing an analog signal indicative of the air temperature. The throttle position sensor 40*b* is operatively connected to the main throttle valve 25 to detect the opening degree of throttle valve 25 for producing an analog signal indicative of the opening degree of throttle valve 25. The negative pressure sensor 40*c* is arranged to detect a negative pressure in the intake manifold 12 for producing an analog signal indicative of the intake manifold negative pressure. The cooling water temperature sensor 40*d* is arranged to detect a temperature of water in the cooling system of the engine 10 for producing an analog signal indicative of the cooling water temperature. The rotational angle sensor 40*e* is arranged to detect a rotational angle of a cam member in a distributor 15 attached to the engine 10 for producing an angular signal indicative of the rotational angle of the engine 10. The exhaust gas oxygen sensor 40*f* is arranged to detect concentration of the oxygen in exhaust gases flowing through an exhaust pipe 16 of the engine for producing an analog signal indicative of the oxygen concentration in the exhaust gases.

The A-D converters 50*a*–50*d* each are applied with the analog signals from the sensors 40*a*–40*d* to convert them into digital signals respectively indicative of the air temperature, the opening degree of throttle valve 25, the intake manifold negative pressure, and the cooling water temperature. The waveform shaper 50*e* is applied with the angular signal from the rotational angle sensor 40*e* to reform it into a rectangular wave signal indicative of the rotational angle of the engine 10. The standard signal generator 50*f* is arranged to produce a standard signal indicative of a predetermined oxygen concentration for a stoichiometric air-fuel ratio. The comparator 50*g* is arranged to compare the analog signal from the exhaust gas oxygen sensor 40*f* with the standard signal from signal generator 50*f* thereby to produce a high level signal when the level of the analog signal is higher than that of the standard signal and to produce a low level signal when the level of the analog signal is lower than that of the standard signal. The high level signal from the comparator 50*g* represents the fact that the concentration of the air-fuel mixture is higher than that defined by the stoichiometric air-fuel ratio, and the low level signal represents the fact that the concentration of the air-fuel mixture is lower than that defined by the stoichiometric air-fuel ratio.

In the electronic air-fuel mixture control system, a microcomputer 60 is adapted to cooperate with the A-D converters 50*a*–50*d*, waveform shaper 50*e* and comparator 50*g* thereby to execute a main control program for control of the stepper motor 30*a* and to execute an interruption control program for control of a relay 70. The computer 60 is connected to a DC voltage source in the form of a vehicle battery B through an ignition switch IG to be activated by closing the ignition switch IG. The computer 60 is further connected to a back-up power source 60*a* and includes therein a back-up random access memory or RAM arranged to be maintained in its activated condition by power supply from the back-up power source 60*a*. The computer 60 is further arranged to initiate execution of the interruption control program in response to opening of the ignition switch IG. The relay 70 is interposed between the DC voltage source B and the computer 60, which relay 70 includes an electromagnetic coil 71 and a normally open switch 72 to be closed by energization of the electromagnetic coil 71.

Hereinafter, the mode of operation of carburetor 20 under control of the computer 60 will be described in detail. Under inoperative condition of the engine 10, the main throttle valve 25 is positioned in its minimum opening position, the auxiliary throttle piston 24 is located in its maximum stroke end to fully close the intake conduit 21*a*, and the needle valve element 36 of drive mechanism 30 is positioned to fully close the air bleed passage 21*f*. Assuming that the ignition switch IG is closed to start the engine 10, the level of vacuum in the mixing chamber R increases in response to operation of the engine, and in turn the level of vacuum in the vacuum chamber 22*b* increases to cause axial displacement of the throttle piston 24 against the compression coil spring 26. Thus, the air is drawn from the air cleaner 13 into the mixing chamber R and is mixed with the fuel drawn into the mixing chamber R from the metering jet 29*e* through the nozzle 28. In this instance, the amount of air is controlled by the axial displacement of throttle piston 24, and the amount of fuel is controlled by the axial displacement of needle valve element 27*a*. The air-fuel mixture formed in such a condition is supplied into the internal combustion engine 10 through the main throttle valve 25 and intake manifold 12.

Figure 4:
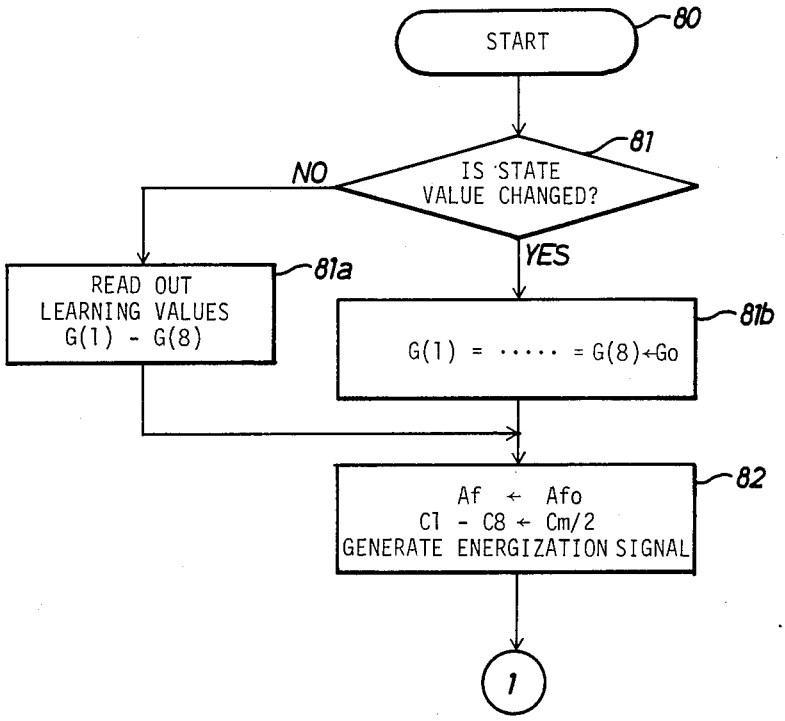
FIGS. 4 and 5 illustrate a flow chart of a main control program for the system shown in FIG. 1.

In the above-described condition, the main control program will be executed by the computer 60 as follows. The computer 60 is activated by closing the ignition switch IG to initiate execution of the main control program at its step 80 shown in FIG. 4. When the main control program proceeds to the following step 81, the computer 60 determines as to whether a state value F memorized in the RAM prior to closing of the ignition switch IG is changed at this stage or not. If the answer is "No", the program proceeds to step 81a where the computer 60 reads out learning values G(1)–G(8) memorized in the RAM prior to closing of the ingition switch IG. If the answer is "Yes", the program proceeds to step 81*b* where the computer 60 sets each of the learning values G(1)–G(8) as a standard learning value Go. In the present invention, the learning values G(1)–G(8) each are determined as a compensation value for correcting the actual rotary step number S of motor 30*a* to the optimum rotary step number So. In this case, the learning values G(1)–G(8) each may correspond with a first air amount region ($0 \leqq Q < Q_1$), a second air amount region ($Q_1 \leqq Q < Q_2$), . . . , and an eighth air amount region ($Q_7 \leqq Q < Q_8$) which are respectively determined by $\frac{1}{8}$ of the entire region between minimum and maximum opening positions of the throttle valve 25. The optimum rotary step number So of motor 30*a* may correspond with an optimum amount of air flowing into the metering jet 29*e* through the air bleed passage 21*f*. The standard learning value Go may corrspond with an average of the respective minimum and maximum learning values G(1)–G(8).

After execution at step 81*a* or 81*b*, the program proceeds to step 82 where the computer 60 acts to set a feedback correction value Af as a standard correction value Afo, to set count values $C_1$–$C_8$ as Cm/2 respectively and to produce an energization signal for the electronic coil 71 of relay 70. In the present invention, the feedback correction value Af is determined as a value for correcting the actual rotary step number of motor 30*a* to the optimum rotary step number So in consideration with oxygen concentration in exhaust gases, the standard correction value Afo may correspond with an optimum rotary step number defined by the stoichiometric air-fuel ratio, and the character Cm represents a maximum count value.

Figure 5:
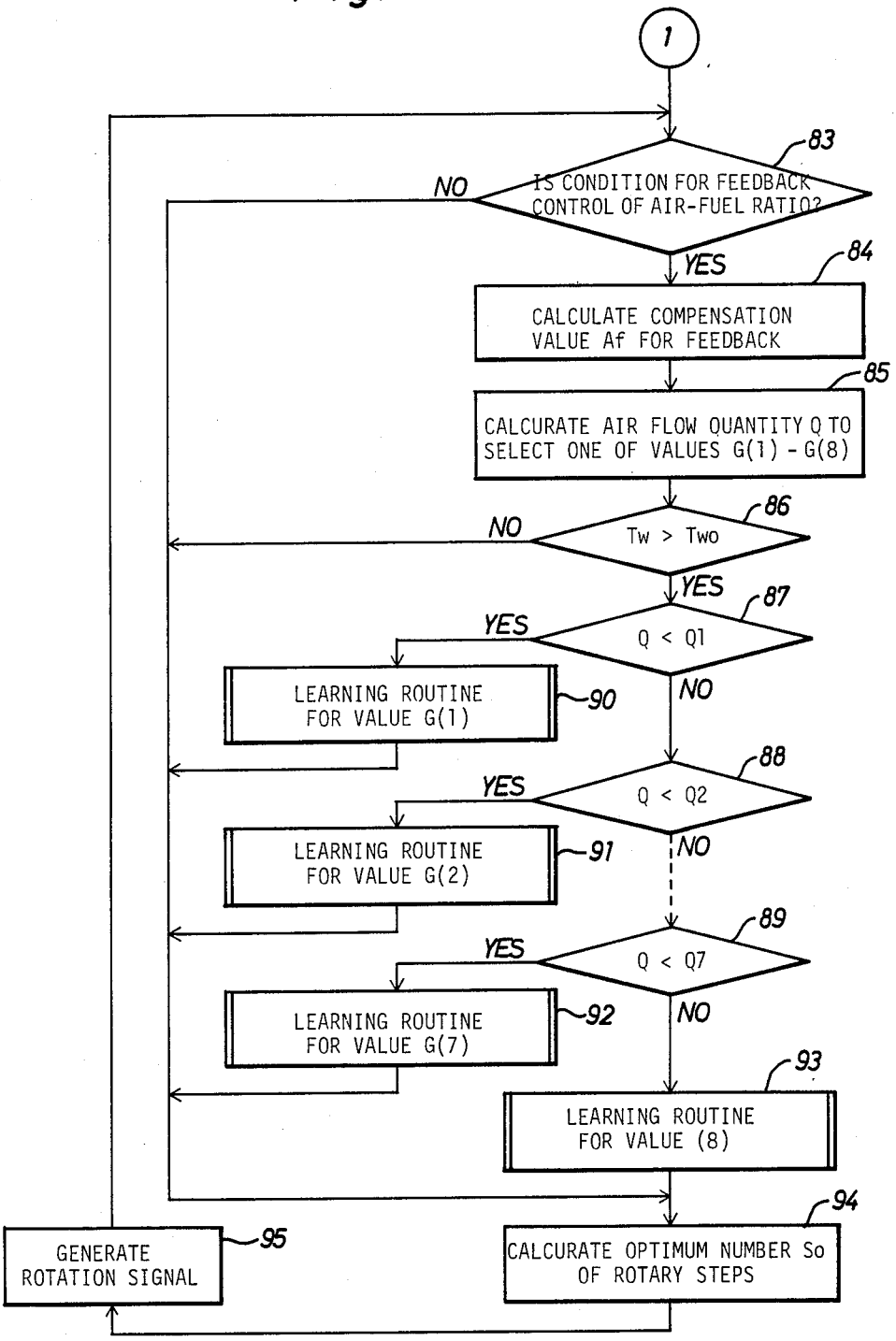

When applied with the energization signal from the computer 60, the electromagnetic coil 71 is energized to close the switch 72 thereby tohold the power supply from DC voltage source B to the computer 60 through the switch 72. Subsequently, the computer 60 causes the main control program to proceed to step 83 shown in FIG. 5. At step 83, the computer 60 cooperates with the A-D converters 50*b*–50*d* and comparator 50*g* to determine as to whether a condition for feedback control of the air-fuel ratio is satisfied or not. If the answer is "Yes", the program will proceed to step 84 where the computer 60 cooperates with the A-D converter 50*b* and comparator 50*g* to calculate a feedback correction value Af in response to the digital signal indicative of the opening degree of throttle valve 25 and the high or low level signal indicative of the actual air-fuel ratio. If the answer is "No", the computer 60 will repeat the determination at step 83 after execution at steps 94 and 95 as described in detail later.

Subsequently, at step 85 of the program, the computer 60 cooperates with the waveform shaper 50*e* and A-D converter 50*c* to calculate an amount Q of the air flow in response to the number of the rectangular wave signals and the digital signal indicative of the intake manifold pressure on a basis of the following equation.

$$Q = K \cdot P \cdot N \tag{1}$$

where K is a proportional constant, P is an absolute intake manifold pressure, and N is rotational speed of the engine 10. Thus, the computer 60 selects one of the air amount regions which corresponds with the calculated amount Q of the air flow and selects one of the learning values G(1)–G(8) which corresponds with the selected air amount region.

Figure 6:
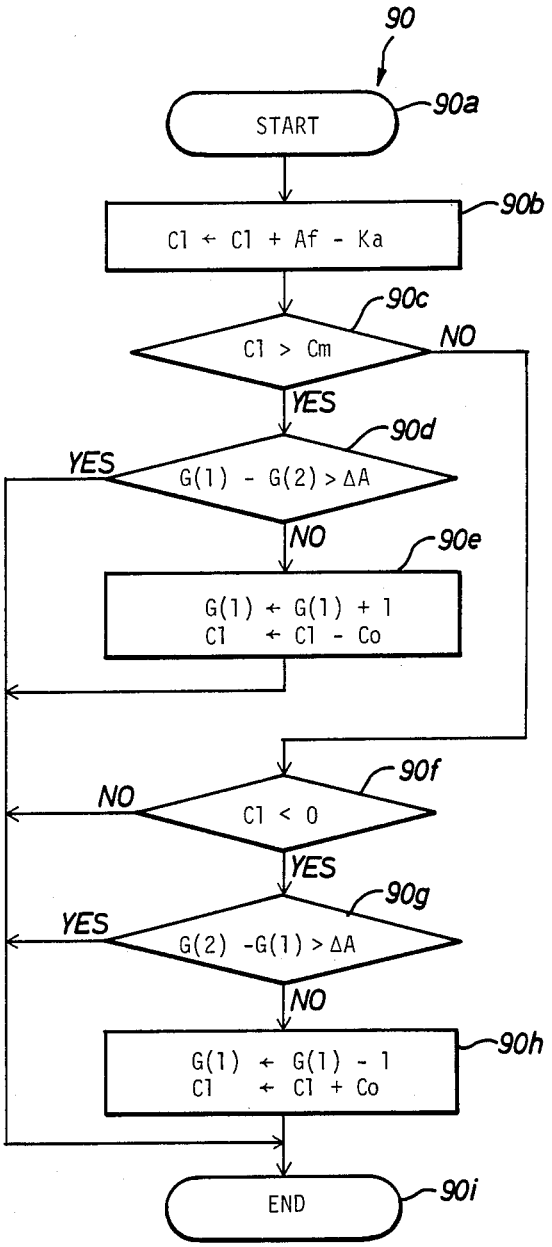
FIGS. 6–9 each illustrate a flow chart of a learning routine for the respective learning values shown in FIG. 4.

When the control program proceeds to step 86, the computer 60 cooperates with the A-D converter 50*d* to determine as to whether or not the value of the digital signal indicative of the cooling water temperature Tw is in excess of a value Two indicative of a condition for warming up of the engine 10. If the answer is "Yes", the program will proceed to step 87 where the computer 60 determines as to whether or not the calculated amount Q of air is in the first air amount region ($0 \leqq Q < Q_1$). Assuming that the calculated amount Q of air is in the first air amount region ($0 \leqq Q < Q_1$), the computer 60 determines a "Yes" answer, causing the program to proceed to a first learning routine 90 for the learning value G(1) shown in FIG. 6.

In the first learning routine 90, the computer 60 starts at step 90*a* to cause the program to proceed to step 90*b*. At step 90*b*, the computer 60 adds the feedback correction value Af to the count value C1 (=Cm/2) and subtracts a constant Ka (=1) from the resultant value of the addition to renew the count value C1 as the resultant value of the subtraction. In this case, the constant Ka is determined as a compensation value for correcting the actual rotary step number S of motor 30*a* to an optimum rotary step number So under non-feedback control. When the count value C1 is less than or equal to the maximum count value Cm and more than or equal to zero, the computer 60 determines a "No" answer respectively at steps 90*c* and 90*f* to end execution of the learning routine 90 at step 90*i* without learning the learning value G(1). Subsequently, the control program proceeds to step 94 shown in FIG. 5, where the computer 60 cooperates with the A-D convertes 50*a*–50*d*, waveform shaper 50*e* and comparator 50*g* to calculate an optimum rotary step number So of motor 30*a* in response to the digital signals respectively indicative of the air temperature, the opening degree of throttle valve 25, the intake manifold negative pressure and the cooling water temperature, the rectagular wave signal indicative of the rotational angle of engine 10, and the high or low level signal indicative of oxygen concentration in the exhaust gases.

In this instance, the calculation of the optimum rotary step number So is carried out on a basis of the following equation.

$$So=Sb+G(i)+Af+Aw+Aa+Ap \quad (2)$$

where Sb is a standard rotary step number of motor 30a for permitting a standard amount of air flowing through the air bleed passage 21*f*;

G(i) is the selected learning value, G(1);

Aw is a compensation value for correcting the actual rotary step number S of motor 30*a* to the optimum rotary step number So in consideration with the cooling water temperature;

Aa is a compensation value for correcting the actual rotary step number S of motor 30*a* to the optimum rotary step number So in consideration with the air temperature; and Ap is a compensation value for correcting the actual rotary step number 5 of motor 30*a* to the optimum rotary step number So in consideration with the absolute intake manifold pressure.

During the execution of the program at step 94, the computer 60 calculates the rotational speed N of the engine 10 in response to the rectangular wave signals from waveform shaper 50*e* and subsequently calculates the standard rotary step number Sb in accordance with the calculated rotational speed N and the value of the digital signal indicative of the intake manifold pressure on a basis of a standard map representing a relationship among the rotational speed N, the intake manifold pressure and the standard rotary step number Sb. The computer 60 further calculates the compensation values Aw, Aa and Ap in response to the digital signals respectively indicative of the cooling water temperature, the air temperature and the intake manifold pressure and finally calculates the optimum rotary step number So based on an addition of the calculated values Sb, Aw, Aa, Ap, the selected learning value G(1), and the feedback correction value Af.

After the foregoing calculation, the computer 60 causes the program to proceed to step 95. At this step 95, the computer 60 produces a rotation signal the value of which represents a difference between the optimum rotary step number So and the actual rotary step number S. In this instance, the actual rotary step number S=0 means the fact that the plunger 30*b* of drive mechanism 30 is in an initial position where the needle valve element 36 cooperates with the annular valve seat 21*g* to fully close the air bleed passage 21*f*. It is, therefore, noted that an increase of the actual rotary step number S corresponds with an increase of axial displacement of the needle valve element 36 against the coil spring 37. When applied with the rotary signal from the computer 60, The motor 30*a* of drive mechanism 30 is activated to rotate the rotor 33 in a forward direction in accordance with the value of the rotation signal thereby to cause axial displacement of the needle value element 36 against the coil spring 37. This results in an increase of the cross-section of the gap for the air bleed passage 21*f*. Thus, the amount of air flowing into the metering jet 29*e* through the air bleed passage 21*f* is controlled in accordance with the axial displacement of needle valve element 36.

When the count value C1 exceeds the maximum count value Cm during repeat of the execution at steps 83–87, 90*a*–90*c*, 90*f*, 90*i*, 94 and 95, the computer 60 will determine a "Yes" answer at step 90*c* of the first learning routine 90, causing the program to proceed to step 90*d*. At this step 90*d*, the computer 60 determines as to whether or not a difference between the learning values G(1) and G(2) is more than an allowable value ΔA. If the answer is "No", the program will proceed to step 90*e* where the computer 60 renews the learning value G(1) by increment of "1" thereto and renews the count value C1 by subtraction of a standard count value Co. In this embodiment, the allowable value ΔA is determined in consideration with allowable fluctuation of the air-fuel ratio of the mixture caused by change of the amount of air flow from one of the air amount regions to the adjacent air amount region, and the standard count value Co is determined to be substantially equal to the value of Cm/2. When the count value C1 decreases less than zero after execution at step 90*e*, the computer 60 determines a "No" answer at step 90*c* and an "Yes" answer at step 90*f*, causing the program to proceed to step 90*g*. At step 90*g*, the computer 60 determines as to whether or not a difference between the learning values G(2) and G(1) is more than the allowable value ΔA. If the answer is "No", the program will proceed to step 90*h* where the computer 60 renews the learning value G(1) by subtraction of "1" therefrom and renews the count value C1 by increment of the standard count value Co.

After renewal of the learning value G(1) and count value C1 at step 90*e* or 90*h*, the computer 60 causes the program to proceed to step 94. At step 94, the computer 60 calculates an optimum rotary step number So in accordance with the renewed learning value G(1) substantially in the same manner as described above. Subsequently, at the following step 95, the computer 60 produces a rotation signal indicative of a difference between the optimum rotary step number So and the actual rotary step number S. Thus, the motor 30*a* of drive mechanism 30 is activated in response to the rotation signal from computer 60 to rotate the rotor 33 in accordance with the value of the rotation signal thereby to cause axial displacement of the needle valve element 36. As a result, the amount of air flowing into the metering jet 29*e* through the air bleed passage 21*f* is controlled in accordance with the learning value G(1) renewed at step 90*e* or 90*h* of the learning routine 90.

From the above description, it will be understood that the first learning routine 90 is programmed to prohibit incremental or subtractive learning of the learning value G(1) when the "No" answer is repeatedly determined at steps 90*c* and 90*f*, to permit incremental learning of the learning value G(1) only when the "Yes" and "No" answers are determined respectively at steps 90*c* and 90*d* and to permit subtractive learning of the learning value G(1) only when the "No", "Yes" and "No" answers are determined respectively at steps 90*c*, 90*f* and 90*g*. With such programming of the first learning routine 90, the learning value G(1) is maintained in a proper value even when the amount Q of air flowing into the induction conduit 21*a* is transiently fluctuated by sudden change of the driving condition, the atmospheric pressure and the like or even when the amount of fuel supplied into the induction conduit 21*a* is transiently fluctuated by sudden change of the air temperature. It is, therefore, able to calculate the optimum rotary step number So at step 94 on a basis of the proper learning value G(1). Consequently, even if the air-fuel ratio of the mixture is disordered due to transient fluctuation of the air or fuel supply amount, it will be controlled in a proper value to reduce noxious content in the exhaust gases and to reduce the fuel consumption. This is also effective to enhance the driveability of the vehicle.

In addition, when the "No" answer is determined at step 90*d* or 90*g* of the first learning routine 90, the difference between learning values G(1) and G(2) is less than the allowable value ΔA. This means that even if the learning value G(1) is changed from the learning value G(2) or vice versa, the optimum rotary step number So at step 94 will be calculated to restrain change of the air-fuel ratio in an allowable extent. When a "Yes" answer is determined at step 90*d* or 90*g* during repeat of the "No" answer at the same step, the computer 60 causes the program to proceed to step 90. This is effective to prohibit renewal of the learning value G(1) when the difference between learning values G(1) and G(2) exceeds the allowable value ΔA. Thus, at step 94, the computer 60 calculates an optimum rotary step number So on a basis of the learning value G(1) renewed immediately before determination of the "Yes" answer at step 90*d* or 90*g*. Consequently, even when the learning value G(1) is changed from the learning value G(2) or vice versa, it is able to restrain change of the amount of bleed air or the air-fuel ratio.

Figure 7:
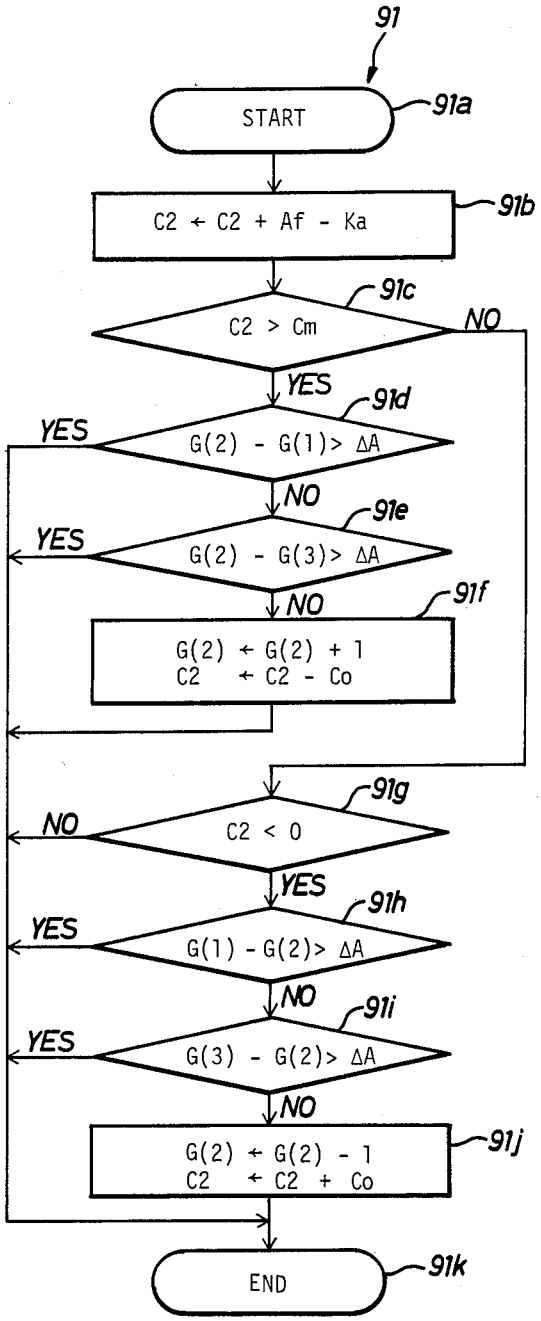

Assuming that the calculated amount of air Q at step 85 is in the second air amount region ($Q_1 \leqq Q < Q_2$), the computer 60 determines a "No" answer at step 87 and determines a "Yes" answer at step 88, causing the program to proceed to a second learning routine 91 shown in FIG. 7. In the second learning routine 91, the computer 60 starts at step 91*a* to cause the program to proceed to step 91*b*. At step 91*b*, the computer 60 adds the feedback correction value Af to the count value C2 (=Cm/2) and subtracts the constant Ka (=1) from the resultant value of the addition to renew the count value C2 as the resultant value of the subtraction.

When the count value C2 is less than or equal to the maximum count value Cm and more than or equal to zero, the computer 60 determines a "No" answer respectively at steps 91*c* and 91*g* to end execution of the learning routine 91 at step 91*k*, causing the program to proceed to step 94. At step 94, the computer 60 calculates an optimum rotary step number So on a basis of the selected learning value G(2) substantially in the same manner as described above to produce a rotation signal indicative of a difference between the optimum rotary step number So and the actual rotary step number S. Thus, the motor 30*a* of drive mechanism 30 is activated in response to the rotation signal from computer 60 to rotate the rotor 33 in accordance with the value of the rotation signal thereby to cause axial displacement of the needle valve element 36. As a result, the actual amount of air flowing into the metering jet 29*e* through the air bleed passage 21*f* is controlled in accordance with the learing value G(2) selected at step 85.

When the count value C2 exceeds the maximum count value Cm during repeat of the execution at steps 83–88, 91*a*–91*c*, 91*g*, 91*k*, 94 and 95, the computer 60 will determine a "Yes" answer at step 91*c* of the second learning routine 91, causing the program to proceed to step 91*d*. At this step 91*d*, the computer 60 determines as to whether or not a difference between the learning values G(2) and G(1) is more than the allowable value ΔA. If the answer is "No", the program will proceed to step 91*e* where the computer 60 further determines as to whether or not a difference between the learning values G(2) and G(3) is more than the allowable value ΔA. If the answer is "No", the program will proceed to step 91*f* where the computer 60 renews the learning value G(2) by increment of "1" thereto and renews the count value C2 by subtraction of the standard count value Co.

When the count value C2 decreases less than zero after execution at step 91*f*, the computer 60 determines a "No" answer at step 91*c* and a "Yes" answer at step 91*g*, causing the program to proceed to step 91*h*. At step 91*h*, the computer 60 determines as to whether or not a difference between the learning values G(1) and G(2) is more than the allowable value ΔA. If the answer is "No", the computer 60 further determines as to whether or not a difference between the learning values G(3) and G(2) is more than the allowable value ΔA. If the answer is "No", the program will proceed to step 91*j* where the computer 60 renews the learning value G(2) by subtraction of "1" therefrom and renews the count value C2 by increment of the standard count value Co.

After renewal of the learning value G(2) and count value C2 at step 91*f* or 91*j*, the computer 60 causes the program to proceed to step 94. At step 94, the computer 60 calculates an optimum rotary step number So in accordance with the renewed learning value G(2) substantially in the same manner as described above. Subsequently, at the following step 95, the computer 60 produces a rotation signal indicative of a difference between the optimum rotary step number So and the actual rotary step number S. Thus, the motor 30*a* of drive mechanism 30 is activated in response to the rotation signal from computer 60 to rotate the rotor 33 in accordance with the value of the rotation signal thereby to cause axial displacement of the needle valve element 36. Consequently, the actual amount of air flowing into the metering jet 29*e* through the air bleed passage 21*f* is controlled in accordance with the learing value G(2) renewed at step 91*f* or 91*j* of the second learning routine 91.

From the above description, it will be understood that the second learning routine 91 is programmed to prohibit incremental or subtractive learning of the learning value G(2) when the "No" answer is repeatedly determined at steps 91*c* and 91*g*, to permit incremental learning of the learning value G(2) only when the "Yes", "No" and "No" answers are determined respectively at steps 91*c*, 91*d* and 91*e* and to permit subtractive learning of the learning value G(2) only when the "No", "Yes", "No" and "No" answers are determined respectively at steps 91*c*, 91*g*, 91*h* and 91*i*. With such programming of the second learning routine 91, the learning value G(2) is maintained in a proper value even when the amount Q of air flowing into the induction conduit 21 is transiently fluctuated by sudden change of the driving condition, the atmospheric pressure and the like or even when the amount of fuel supplied into the induction conduit 21*a* is transiently fluctuated by sudden change of the air temperature. It is, therefore, able to calculate the optimum rotary step number So at step 94 on a basis of the proper learning value G(2). Consequently, even if the air-fuel ratio of the mixture is disordered due to transient fluctuation of the air or fuel supply amount, it will be controlled in a proper value to reduce noxious content in the exhaust gases and to reduce the fuel consumption.

In addition, wher the "No" answer is determined at steps 91*d* and 91*e* or 91*h* and 91*i* of the second learning routine 91, each difference between learning values G(2) and G(1) and between learnimg values G(2) and G(3) is less than the allowable value ΔA. This means that even if the learning value G(2) is changed from the learning value G(1) or G(3) or vice versa, the optimum rotary step number So will be calculated at step 94 to restrain change of the air-fuel ratio in the allowable extent. When a "Yes" answer is determined at one of steps 91*d* and 91*e* or one of steps 91*h* and 91*i*, the computer 60 causes the program to proceed to step 91*k*. This is effective to prohibit renewal of the learning value G(2) when the difference between learning values G(2) and G(1) or G(2) and G(3) exceeds the allowable value ΔA. Thus, at step 94 of the program, the computer 60 calculates an optimum rotary step number So on a basis of the learning value G(2) renewed immediately before determination of the "Yes" answer at one of steps 91*d* and 91*e* or one of steps 91*h* and 91*i*. Consequently, even when the learning value G(2) changes from the learning value G(1) or G(3), it is able to restrain change of the amount of bleed air or the air fuel-ratio.

Figure 8:
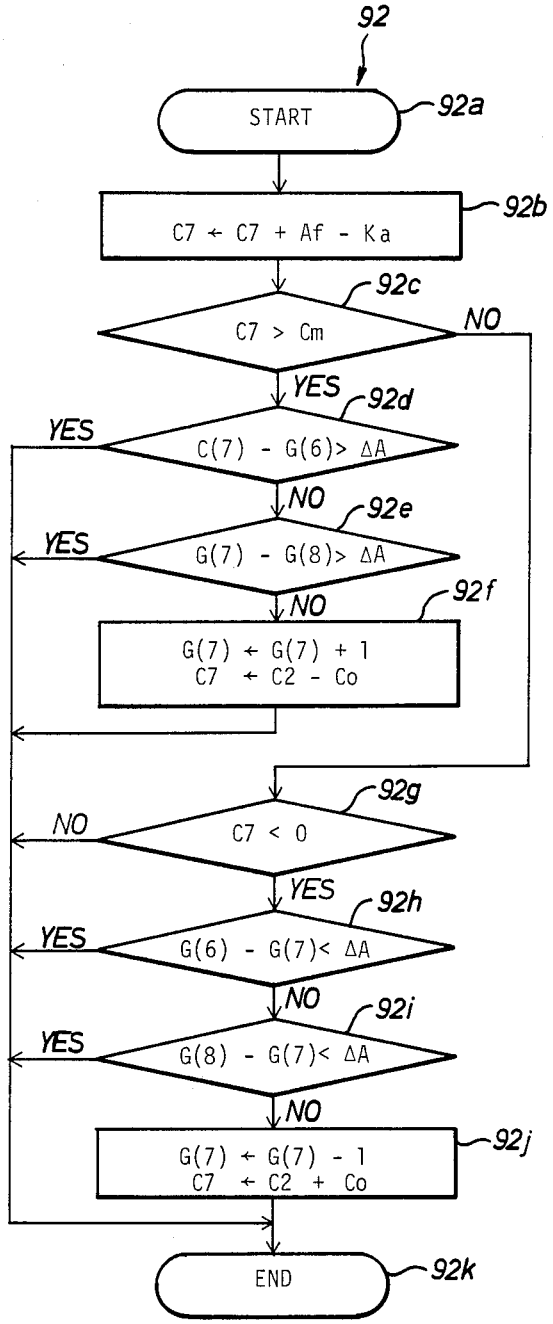

Subsequently, the computer 60 will selectively execute each learning routine (not shown) for the learning values G(3)–G(7) in accordance with change of the calculated amount Q of air at step 85. Assuming that at step 89 of the program, the calculated amount Q of air is in the seventh air amount region ($Q_7 \leqq Q < Q_8$), the computer 60 determines a "Yes" answer, causing the program to proceed to a seventh learning routine 92 for the learning value G(7) shown in FIG. 8. In the seventh learning routine 92, the computer 60 starts at step 92*a* to cause the program to proceed to step 92*b*. At step 92*b*, the computer 60 adds the feedback correction value Af to the count value C7 (=Cm/2) and subtracts the constant Ka (=1) from the resultant value of the addition to renew the count value C7 as the resultant value of the subtraction.

When the count value C7 is less than or equal to the maximum count value Cm and more than or equal to zero, the computer 60 determines a "No" answer respectively at steps 92*c* and 92*g* to end execution of the learning routine 92 at step 92*k*, causing the program to proceed to step 94. At step 94, the computer 60 calculates an optimum rotary step number So on a basis of the selected learning value G(7) substantially in the same manner as described above to produce a rotation signal indicative of a difference between the optimum rotary step number So and the actual rotary step number S at step 95. Thus, the motor 30*a* of drive mechanism 30 is activated in response to the rotation signal from computer 60 to rotate the rotor 33 in accordance with the value of the rotation signal thereby to cause axial displacement of the needle valve element 36. As a result, the actual amount of air flowing into the metering jet 29*e* through the air bleed passage 21*f* is controlled in accordance with the learing value G(7) selected at step 85.

When the count value C7 exceeds the maximum count value Cm during repeat of the execution at steps 83– 89, 92*a*–92*c*, 92*g*, 92*k*, 94 and 95, the computer 60 will determine a "Yes" answer at step 92*c* of the second learning routine 92, causing the program to proceed to step 92*d*. At this step 92*d*, the computer 60 determines as to whether or not a difference between the learning value G(7) and G(6) is more than the allowable value ΔA. If the answer is "No", the program will proceed to step 92*e* where the computer 60 further determines as to whether or not a difference between the learning values G(7)) and G(8) is more than the allowable value ΔA. If the answer is "No", the program will proceed to step 92*f* where the computer 60 renews the learning value G(7) by increment of "1" therefore and renews the count value C7 by subtraction of the standard count value Co.

When the count value C7 decreases less than zero after execution at step 92*f*, the computer 60 determines a "No" answer at step 92*c* and a "Yes" answer at step 92*g*, causing the program to proceed at step 92*h*. At step 92*h*, the computer 60 determines as to whether or not a difference between the learning values G(6) and G(7) is more than the allowable value ΔA. If the answer is "No", the program proceeds to step 92*i* where the computer 60 further determines as to whether or not a difference between the learning values G(8) and G(7) is more than the allowable value ΔA. If the answer is "No", the program will proceed to step 92*j* where the computer 60 renews the learning value G(7) by subtraction of "1" therefrom and renews the count vaue C7 by increment of the standard count value Co.

After renewal of the learning value G(7) and count value C7 at step 92*f* or 92*j*, the computer 60 causes the program to proceed to step 94. At step 94, the computer 60 calculates an optimum rotary step number So in accordance with the renewed learning value G(7) substantially in the same manner as described above. Subsequently, at the following step 95, the computer 60 produces a rotation signal indicative of a difference between the optimum rotary step number So and the actual rotary step number S. Thus, the motor 30*a* of drive mechanism 30 is activated in response to the rotation signal from computer 60 to rotate the rotor 33 in accordance with the value of the rotation signal thereby to cause axial displacement of the needle valve element 36. Consequently, the actual amount of air flowing into the metering jet 29*e* through the air bleed passage 21*f* is controlled in accordance with the learning value G(7) renewed at step 92*f* for 92*j* of the second learning routine 91.

From the above description, it will be understood that the seventh learning routine 92 is programmed to prohibit incremental or subtractive learning of the learning value G(7) when the "No" answer is repeatedly determined at steps 92*c* and 92*g*, to permit incremental learning of the learning value G(7) only when the "Yes", "No" and "No" answers are determined respectively at steps 92*c*, 92*d* and 92*e* and to permit subtractive learning of the learning value G(7) only when the "No", "Yes", "No" and "No" answers are determined respectively at steps 92*c*, 92*g*, 92*h* and 92*i*. With such programming of the learning routine 92, the learning value G(7) is maintained in a proper value even when the actual amount Q of air flowing into the induction conduit 21 is transiently fluctuated by sudden change of the driving condition, the atmospheric pressure and the like or even when the actual amount of fuel supplied into the induction conduit 21*a* is transiently fluctuated by sudden change of the air temperature. It is, therefore, able to calculate the optimum rotary step number So at step 94 on a basis of the proper learning value G(7). Consequently, even if the air fuel ratio of the mixture is disordered due to transient fluctuation of the air or fuel supply amount, it will be controlled in a proper value to reduce noxious content in the exhaust gases and to reduce the fuel consumption.

In addition, when the "No" answer is determined at steps 92*d* and 92*e* or 92*h* and 92*i* of the learning routine 92, each difference between learning values G(7) and G(6) and between learning values G(7) and G(8) is less than the allowable value ΔA. This means that even if the learning value G(7) is changed from the learning value G(6) or G(8) or vice versa, the optimum rotary step number So will be calculated at step 94 to restrain change of the air-fuel ratio in the allowable extent. When a "Yes" answer is determined at one of steps 92*d* and 92*e* or one of steps 92*h* and 92*i*, the computer 60 causes the program to proceed to step 92*k*. This is effective to prohibit renewal of the learning value G(7) when the difference between learning values G(7) and G(6) or C(7) and G(8) exceeds the allowable value ΔA. Thus, at step 94 of the program, the computer 60 calculates an optimum rotary step number So on a basis of the learning value G(7) renewed immediately before determination of the "Yes" answer at one of steps 92*d* and 92*e* or one of steps 92*h* and 92*i*. Consequently, even when the learning value G(7) is changed from the learning value G(6) or G(8), iL is able to restrain change of the amount of bleed air or the air fuel-ratio.

Figure 9:
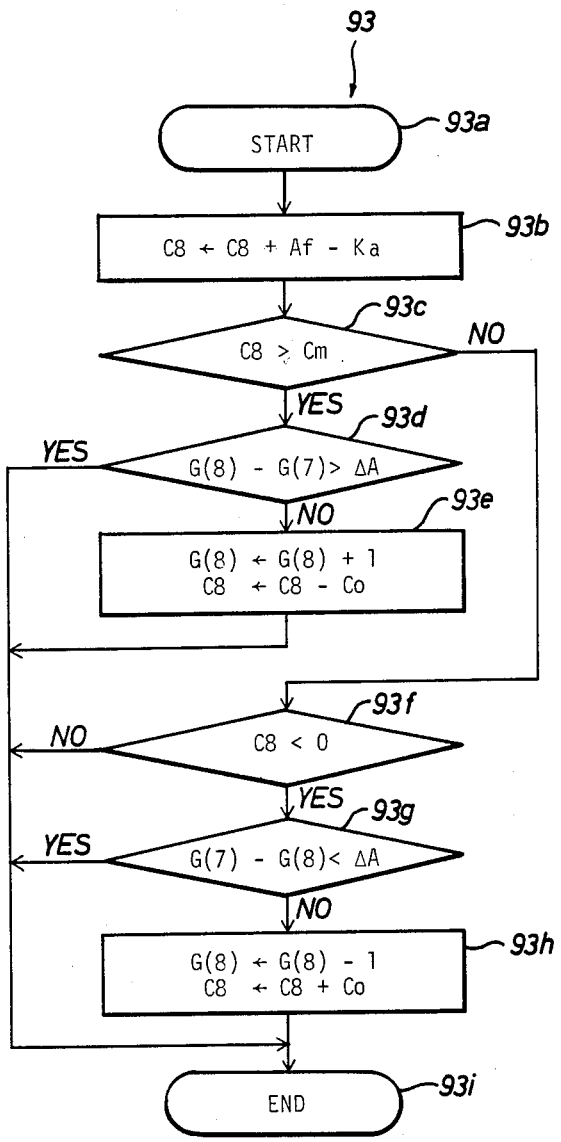

When the computer 60 determines a "No" answer at step 89 because of further change of the calculated amount Q of air at step 85, it causes the program to proceed to an eighth learning routine 93 for the learning value G(8) shown in FIG. 9. In the learning routine 93, the selected learning value G(8) will be renewed at step 93*e* or 93*h* substantially in the same manner as that in the first learning routine 90.

Figure 10:
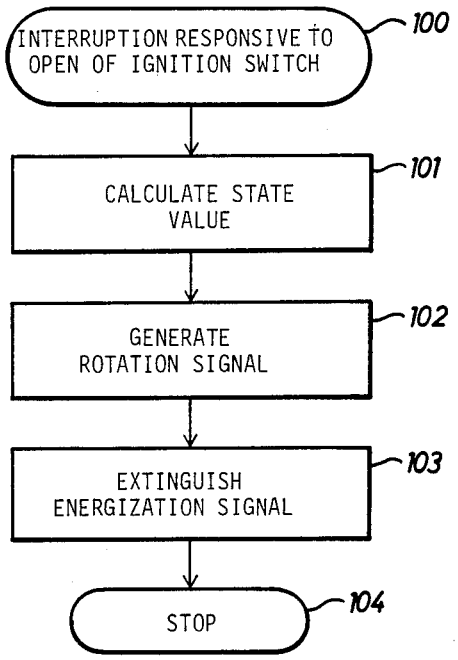
FIG. 10 is a flow chart of an interruption control program.
Figure 11:
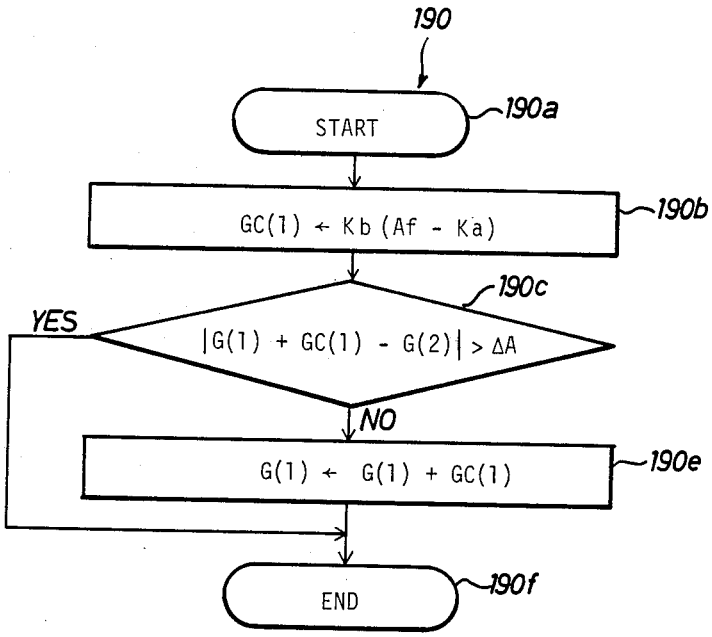
FIGS. 11–14 each illustrate a modification of the respective learning routines shown in FIGS. 6–9.

When the ignition switch IG is opened to stop the engine during arrest of the vehicle, the computer 60 is maintained in its activated condition by power supply across the switch 72 to execute the interrution control routine shown in FIG. 10. In this instance, the computer 60 starts at step 100 to cause the program to proceed to step 101. At step 101, the computer 60 adds complement to the renewed learning value G(1) to memorize the resultant of the addition as a state value F. At step 102, the computer 60 produces a rotation signal for rotating the stepper motor 30*a* toward the initial position. Thus, the stepper motor 30*a* is activated by the rotation signal from computer 60 to displace the needle valve element 36 to the initial position. When the program proceeds to step 103, the computer 60 puts out the energization signal to deenergize the electromagnetic coil 71 so as to open the switch 72. Finally, the computer 60 stops the execution of the main control program at step 104. In such a condition, the back-up RAM of computer 60 is maintained in its activated condition by power supply from the back-up source 60*a* to memorize therein the renewed learning values G(1)–G(8) and the state value F. In the carburetor 20, the auxiliary throttle piston 24 is returned to its maximum stroke end under the biasing force of compression spring 26.

In the actual practice of the present invention, the respective learning routines 90–93 may be modified as shown in FIGS. 11–14. Assuming that in such a modification, a "Yes" answer is determined at step 87 of the m ain control program, the computer 60 causes the program to proceed to a first learning routine 190 of FIG. 11. At step 190*a*, the computer 60 starts to cause the program to proceed to step 190*b*. At step 190*b*, the computer 60 subtracts a constant Ka from the feedback correction value Af and multiplies the subtracted value by the constant Kb to renew a count value GC(1) as the multiplied value. In this case, the constant Kb is determined in a value similar to the constant Ka. At the following step 190*c*, the computer 60 determines a "Yes" answer if an absolute value of [G(1)+GC(1)−G(2)] is more than the allowable value ΔA. This is effective to prohibit learning of the learning value G(1). When the absolute value of [G(1)+GC(1)−G(2)] is less than the allowable value ΔA, the computer 60 determines a "No" answer at step 190*c* and causes the program to proceed to step 190*e*. At step 190*e*, the computer 60 renews the learning value G(1) by increment of the count value GC(1).

Figure 12:
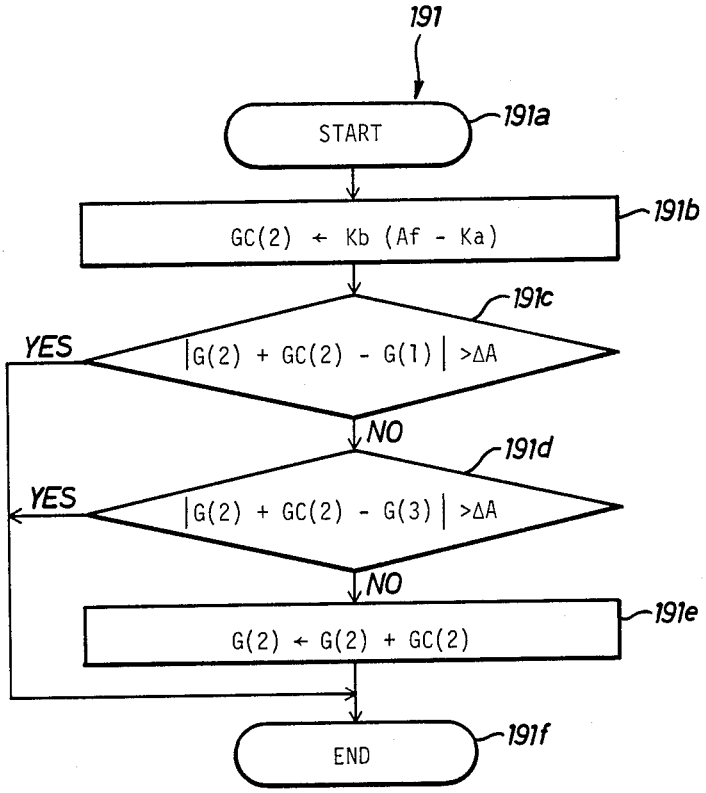

When a "Yes" answer is determined at step 88 of the main control program, the computer 60 causes the program to proceed to a second learning routine 191 of FIG. 12. At step 191*a*, the computer 60 starts to cause the program to proceed to step 191*b*. At step 191*b*, the computer 60 subtracts the constant Ka from the feedback correction value Af and multiples the subtracted value by the constant Kb to renew a count value GC(2) as the multiplied value. At the following step 191*c*, the computer 60 determines a "Yes" answer if an absolute value of [G(2)+GC(2)−G(1)] is more than the allowable value ΔA. This is effective to prohibit learning of the learning value G(2). When the absolute value of [G(2)+GC(2)−G(1)] is less than the allowable value ΔA, the computer 60 determines a "No" answer at step 191*c* and causes the program to proceed to step 191*d*. If at step 191*d* an absolute value of [G(2)+GC(2)−G(3)] is more than the allowable value ΔA, the computer 60 will determine a "Yes" answer to prohibit learning of the learning value G(2). When the absolute value of [G(2)+GC(2)−G(3)] is less than the allowable value ΔA, the program proceeds to step 191*e* where the computer 60 renews the learning value G(2) by increment of the count value GC(2).

Figure 13:
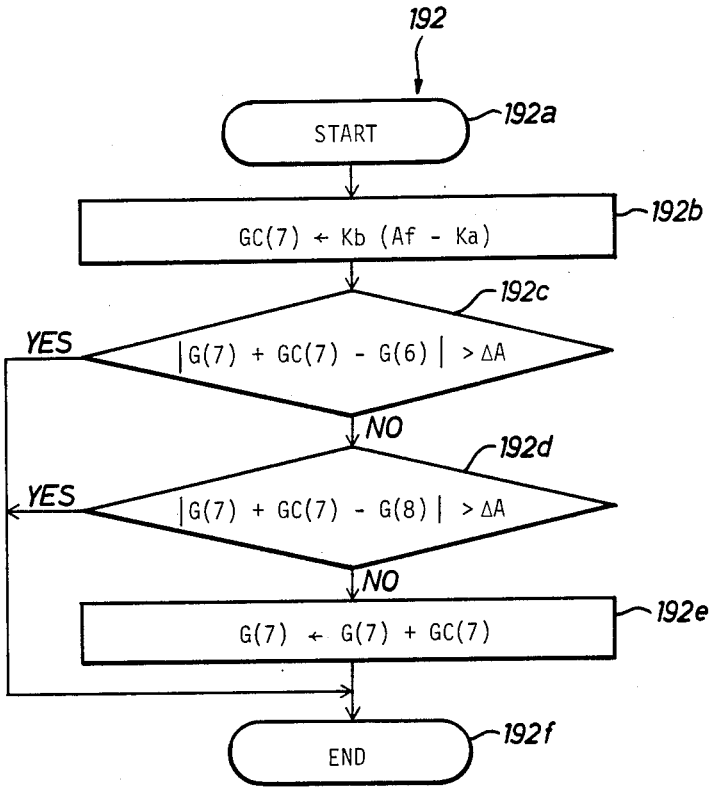

When a "Yes" answer is determined at step 89 of the main control program, the computer 60 causes the program to proceed to a third learning routine 192 of FIG. 13. At step 192*a*, the computer 60 starts to cause the program to proceed to step 192*b*. At step 192*b*, the computer 60 subtracts the constant Ka from the feedback correction value Af and multiples the subtracted value by the constant Kb to renew a count value GC(7) as the multiplied value. At the following step 192*c*, the computer 60 determines a "Yes" answer if an absolute value of [G(7)+GC(7)−G(6)] is more than the allowable value ΔA. This is effective to prohibit learning of the learning value G(7). When the absolute value of [G(7)+GC(7)−G(6)] is less than the allowable value ΔA, the computer 60 determines a "No" answer at step 192*c* and causes the program to proceed to step 192*d*. If at step 192*d* an absolute value of [G(7)+GC(7)−G(8)] is more than the allowable value ΔA, the computer 60 will determine a "Yes" answer to prohibit learning of the learning value G(7). When the absolute value of [G(7)+GC(7)−G(8)] is less than the allowable value ΔA, the program proceeds to step 192*e* where the computer 60 renews the learning value G(7) by increment of the count value GC(7).

Figure 14:
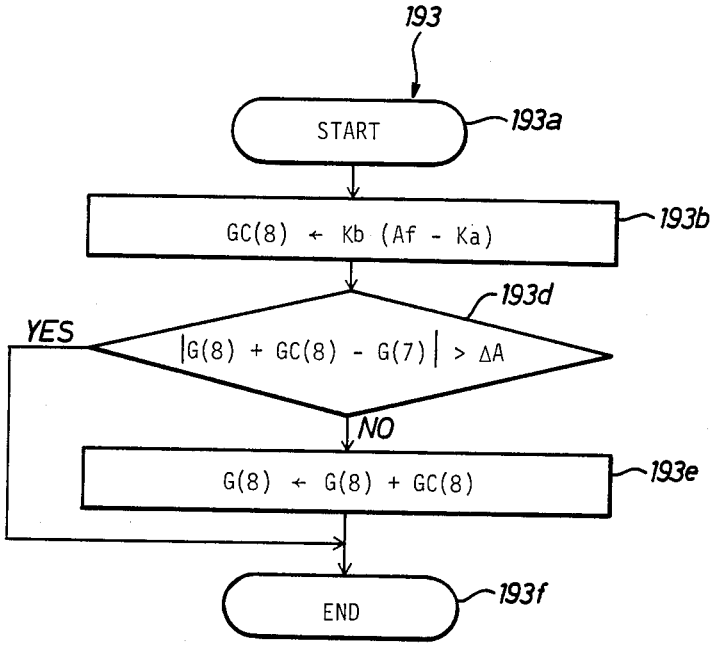

When a "No" answer is determined at step 89 of the main control program, the computer 60 causes the program to proceed to a fourth learning routine 193 of FIG. 14. At step 193*a*, the computer 60 starts to cause the program to proceed to step 193*b*. At step 193*b*, the computer 60 subtracts the constant Ka from the feedback correction value Af and multiplies the subtracted value by the constant Kb to renew a count value GC(8) as the multiplied value. At the following step 193*d*, the computer 60 determines a "Yes" answer if an absolute value of [G(8)+GC(8)−G(7)] is more than the allowable value ΔA. This is effective to prohibit learning of the learning value G(8). When the absolute value of [G(8)+GC(8)−G(7)] is les than the allowable value ΔA, the computer 60 determines a "No" answer at step 193*d* and causes the program to proceed to step 193*e*. Thus, the computer 60 renews the learning value G(8) by increment of the count value GC(8).

From the above description, it will be understood that the modified learning routines 190–193 are programmed to prohibit incremental learning of the respective learning values G(1)–G(8) when the "Yes" answer is determined at steps 190*c*, 191*c* or 19*d*, 192*c* or 192*d*, or 193*d* and to permit the incremental learning of the learning values G(1)–G(8) when the "No" answer is determined at steps 190*c*, 191*d*, 192*d* or 193*d*.

Although the foregoing embodiment and its modification have been adapted to a carburetor of the variable venturi type, the present invention may be adapted to a carburetor of the fixed vernturi type. Furthermore, the present invention may be adapted to an electronic fuel injection system.

Having now fully set forth both structure and operation of preferred embodiments of the concept underlying the present invention, various other emodiments as well as certain variations and modifications of the embodiments herein shown and described will obviously occur to those skilled in the art upon becoming familiar with said underlying concept. It is, therefore, to be understood that within the scope of the appended claims, the invention may be practiced otherwise than as specifically set forth herein.

What is claimed is:

1. An electronic air-fuel mixture control system for an internal combustion engine, having an induction passage for conducting air-fuel mixture into said engine, fuel control means for controlling the amount of fuel metered into said air induction passage, and throttle means for controlling the amount of air flowing into said engine through said induction passage, said control system comprising:

first detecting means for producing a first signal indicative of the load acting on said engine;

second detecting means for producing a second signal indicative of the operating conditions of said engine;

means responsive to said first signal for selecting one of plural learning values in accordance with the engine load, said plural learning values being related to a plurality of load regions of said engine;

learning means for learning the selected learning value, said learning means being arranged to prohibit learning of the selected learning value when a difference between the selected learning value and an adjacent learning value is more than a predetermined allowable value;

means responsive to said second signal for determining an amount of fuel for an optimum air-fuel ratio in accordance with the operation conditions of said engine and the selected learning value; and means for producing an output signal indicative of the determined amount of fuel to apply it to said fuel control means.

2. An electronic air-fuel mixture control system as claimed in claim 1, wherein the predetermined allowable value is determined in consideration with allowable fluctuation of the air-fuel ratio of the mixture caused by change of the amount of air flowing into said engine through said induction passage.

3. An electronic air-fuel mixture control system as claimed in claim 1, further comprising means for producing a third signal indicative of oxygen concentration in exhaust gases discharged from said engine, and means responsive to said third signal for determining a feedback correction value in dependence upon the oxygen concentration in exhaust gases, and wherein said learning means is arranged to renew the selected learning value in dependence upon the feedback correction value.

4. An electronic air-fuel mixture control system for a carburetor adapted to an internal combustion engine, said carburetor including an induction passage with a venturi portion, a fuel passage supplying fuel from a float chamber into said venturi portion, an air bleed passage permitting the flow of air into said fuel passage to be mixed with the fuel, and air control means for controlling the amount of air flowing into said fuel passage through said air bleed passage, said control system comprising:

first detecting means for producing a first signal indicative of the load acting on said engine;

second detecting means for producing a second signal indicative of the operating conditions of said engine;

means responsive to said first signal for selecting one of plural learning values in accordance with the engine load, said plural learning values being related to a plurality of load regions of said engine;

learning means for learning the selected learning value, said learning means being arranged to prohibit learning of the selected learning value when a difference between the selected learning value and an adjacent learning value is more than a predetermined allowable value;

means responsive to said second signal for determining an amount of air for an optimum air-fuel ratio in accordance with the operating conditions of said engine and the selected learning value; and means for producing an output signal indicative of the determined amount of air to apply it to said air control means.

5. An electronic air-fuel mixture control system for a carburetor adapted to an internal combustion engine, said carburetor including an induction passage with a venturi portion, a fuel passage supplying fuel from a float chamber into said venturi portion, an air bleed passage permitting the flow of air into said fuel passage to be mixed with the fuel, and air control means for controlling the amount of air flowing into said fuel passage through said air bleed passage, said control system comprising:

first detecting means for producing a first signal indicative of the amount of air flowing into said engine through said induction passage;

second detecting means for producing a second signal indicative of parameters of said engine such as intake manifold pressure, air temperature, enging speed, cooling water temperature, oxygen concentration in exhaust gases and the like;

means for defining plural learning values related to a plurality of air amount regions in said induction passage;

means responsive to said first signal for selecting one of said learning values in accordance with the amount of air flowing into said engine through said induction passage;

learning means for learning the selected learning value, said learning means being arranged to prohibit learning of the selected learning value when a difference between the selected learning value and an adjacent learning value is more than a predetermined allowable value;

means responsive to said second signal for determining an amount of air for an optimum air-fuel ratio in accordance with the parameters of said engine and the selected learning value; and means for producing an output signal indicative the determined amount of air to apply it to said air control means.

* * * * *